US005451436A

United States Patent [19]

Shelleman

[11] Patent Number: 5,451,436

[45] Date of Patent: Sep. 19, 1995

[54] ORNAMENTAL, WIRE-FRAME DEVICE CONNECTOR

[75] Inventor: Roger L. Shelleman, Columbia, Md.

[73] Assignee: Everstar Merchandising Co., U.S.A., Beltsville, Md.

[21] Appl. No.: 320,234

[22] Filed: Oct. 11, 1994

[51] Int. Cl.[6] ..... A63H 3/16; B44C 3/06

[52] U.S. Cl. ..... 428/8; D11/158; 428/16; 446/373

[58] Field of Search ..... 362/124, 808; 428/8, 428/16; 446/370, 371, 373; D11/158

[56] References Cited

U.S. PATENT DOCUMENTS

| | | | |
|---|---|---|---|
| D. 162,405 | 3/1951 | Gresham | D11/158 X |
| 1,639,493 | 8/1927 | Fischer | 362/124 |
| 4,650,701 | 3/1987 | Jackson | 428/16 |

*Primary Examiner*—Henry F. Epstein
*Attorney, Agent, or Firm*—Donald A. Kettlestrings

[57] ABSTRACT

An ornamental, wire-frame device connector includes connector elements attached to the wires of separable parts of the device, and each connector defines a plurality of openings for removably receiving fastening elements whereby the separable parts of the wire-frame device are removably connected together.

6 Claims, 2 Drawing Sheets

10
12
12'
14
14'
16
16'
18
18'
20
20'
22
22'
24
24'
26
26'
28
30
30'
32
32'
34
36
38

ORNAMENTAL, WIRE-FRAME DEVICE CONNECTOR

BACKGROUND OF THE INVENTION

This invention relates to connectors and more particularly to connectors for use with ornamental, wire-frame devices.

Ornamental, wire-frame figures are used for decorating landscapes and other areas. Such figures are most commonly used during the Christmas holidays to represent, for example, reindeer, sleighs, angels, birds and Santa Claus. Lights are frequently attached to the wire-frame figures so that the figures may be visible at night.

Many of the wire-frame figures are of such a size and bulk that it is desirable to form the figures by separable parts. The separable parts can be connected together to form the figure, and the parts can be separated for storage or transport.

It is important that the separable parts be connectable together in a quick and easy manner, and it is also important that connectors for the separable parts of the figures be of simple construction.

It is, therefore, an object of the present invention to provide connectors for use with ornamental, wire-frame figures or devices.

Another object is to provide such connectors which enable separable parts of ornamental, wire-frame figures to be quickly and easily connected and disconnected with respect to each other.

A further object of the invention is the provision of connectors for use with ornamental, wire-frame figures wherein the connectors are simple and inexpensive to manufacture.

Still another object is to provide such connectors which are easy to use and which will enable a person to quickly assemble and disassemble the separable parts of a wire-frame figure.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

SUMMARY OF THE INVENTION

To achieve these and other objects the present invention provides a connector for use in an ornamental, wire-frame figure or device which has at least first and second separable parts and wherein each of the parts is formed by first and second wire, respectively, the connector comprising: a first connector element defining a first plurality of openings therein, the first connector element connected to the first wire; a second connector element defining a second plurality of openings therein, the second connector element connected to the second wire; and a plurality of fastening elements for removably positioning through the first and second plurality of openings and for removably fastening together the first and second connector elements and the first and second parts of the wire-frame figure.

It is to be understood that both the foregoing general description and the following detailed description are exemplary and explanatory but are not restrictive of the invention.

BRIEF DESCRIPTION OF THE DRAWINGS

The accompanying drawings, which are incorporated in and constitute a part of this specification, illustrate examples of preferred embodiments of the invention and, together with the description, serve to explain the principles of the invention.

DESCRIPTION OF THE PREFERRED EMBODIMENTS

Figures 1, 2, 3:
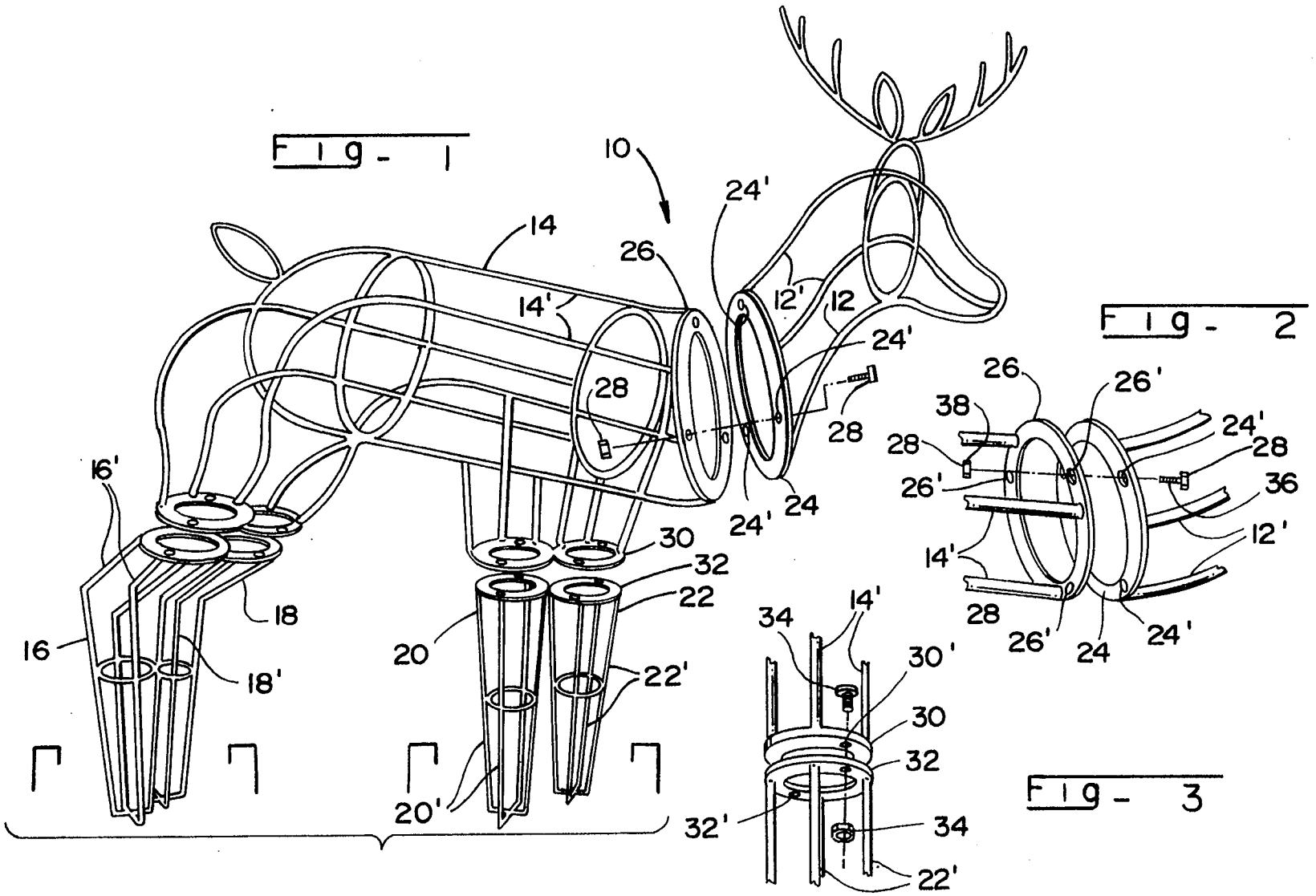
FIG. 1 is an exploded perspective view of an ornamental, wire-frame deer figure showing parts of the figure separated from each other and showing the connector of this invention.
FIG. 2 is a fragmentary exploded perspective view showing in more detail one embodiment of the connector of this invention associated with the body part and the head part of the deer figure shown in FIG. 1.
FIG. 3 is a fragmentary exploded perspective view showing in more detail an embodiment of the connector of this invention associated with the body part and a leg part of the deer figure shown in FIG. 1.

With reference now to the drawings, wherein like reference characters designate like or corresponding parts throughout the several views, there is shown in FIGS. 1–3 one example of connectors in accordance with this invention used in an ornamental, wire-frame FIG. 10 of a deer. As illustrated in FIG. 1, FIG. 10 includes separable parts 12–22, specifically, head part 12, body part 14, rear leg parts 16, 18 and front leg parts 20, 22. Each of parts 12–22 is formed by conventional, heavy gauge, rigid wire 12'–22', respectively.

In accordance with the invention, a first connector element 24 is connected to first wire 12' and defines a first plurality of openings 24' therein. A second connector element 26 is connected to second wire 14' and defines a second plurality of openings 26' therein.

A plurality of fastening elements, generally indicated as 28, are provided for removably positioning through openings 24', 26', for removably fastening together connector elements 24, 26, and for removably fastening together head part 12 and body part 14. Connector elements 24, 26 are also shown in FIG. 2.

FIG. 3 illustrates third and fourth connector elements 30, 32. Connector element 30 is fastened to wire 14', and connector element 32 is fastened to wire 22'. Connector element 30 defines at least two openings 30' therein, and connector element 32 defines at least two openings 32' therein. Fastening elements 34 are provided for removably positioning through openings 30', 32', for removably fastening together connector elements 30, 32, and for removably fastening together separable parts 14, 22. Each of remaining parts 16–20 are similarly constructed with heavy gauge, rigid wire and with similarly constructed connector elements.

Each of the connector elements for each separable part 12–22 is preferably flat. The openings in each of the connector elements are located so as to be in alignment with openings of an adjacent connector element when the connector elements are positioned together to connect together the separable parts of device 10.

Fastening elements 28, 34 and the fastening elements used with each connector element shown in FIG. 1 are preferably bolts 36 and nuts 38 threadable onto bolts 36, as shown in FIG. 2.

The connector elements may be provided in various shapes and sizes to accommodate the design of the wire-frame figure in which the connector elements are used. For example, connector elements 24, 26, 30, 32 and the other connector elements used in wire-frame FIG. 10 are each ring-shaped to accommodate the design of the deer figure.

Figures 4, 5:
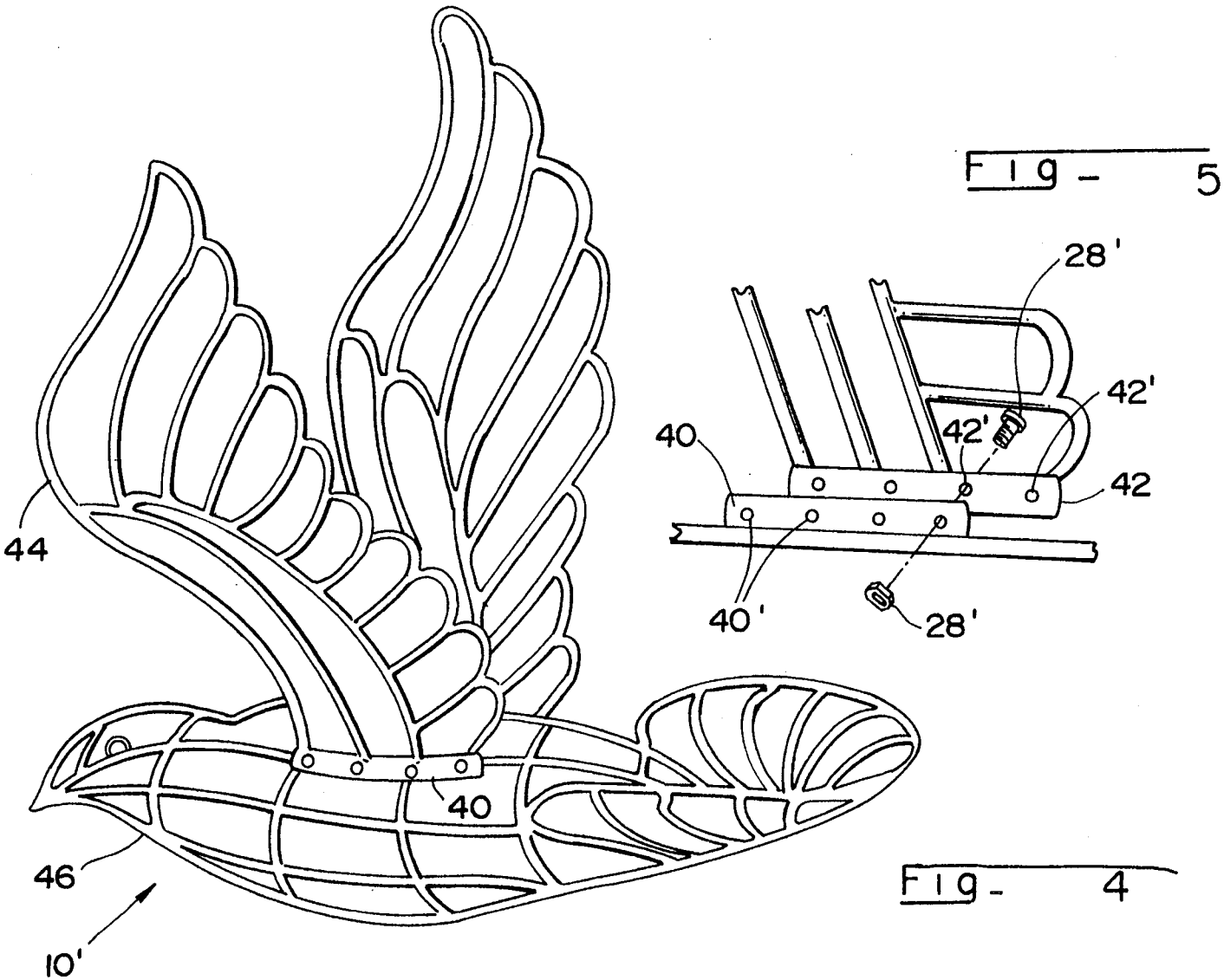
FIG. 4 is a perspective view of an ornamental, wire-frame dove figure.
FIG. 5 is a fragmentary exploded perspective view showing in more detail another embodiment of the connector of this invention associated with the body part and a wing part of the dove figure shown in FIG. 4.

One example of an alternative wire-frame figure design is illustrated in FIGS. 4 and 5. In this embodiment wire-frame FIG. 10' is that of a dove, and connector elements 40, 42 are essentially rectangular in shape to accommodate the design of the dove and the configuration of the joint between the dove's body and the wing of the dove. Each wing part is attached to the body part of the dove in the same manner as shown in figure 5.

As in the previously described deer figure embodiment, connector elements 40, 42 are each provided with a plurality of openings 40', 42', respectively, therein. Fastening elements generally designated as 28' are provided for removably positioning through openings 40', 42' to removably fasten together connector elements 40, 42 and to removably fasten together wing part 44 from body part 46 of wire-frame dove FIG. 10'.

In operation and use of wire-frame deer FIG. 10, for example, head part 12 can be quickly and easily connected or disconnected with respect to body part 14 by positioning connector elements 24, 26 together with openings 24' and 26' in alignment with each other. Bolts 36 can then be inserted through the openings and nuts 38 can be threadably positioned over the bolts and tightened to firmly hold parts 12, 14 together. The remaining parts of FIG. 10 can be similarly assembled and disassembled. Likewise, the parts of dove figure 10' can be connected together and disconnected by use of connector elements 40, 42 in cooperation with fastening elements 28'.

This invention provides for connector elements used with wire-frame ornamental figures for connecting together separable parts of the figures. The figure parts can be quickly and easily assembled for use and quickly and easily disassembled for storage or transportation.

The invention in its broader aspects is not limited to the specific details shown and described, and departures may be made from such details without departing from the principles of the invention and without sacrificing its chief advantages.

What is claimed is:

1. In an ornamental, wire-frame device having at least first and second separable parts, each of said parts formed by first and second wire, respectively, the improvement comprising:

a first connector element defining a first plurality of openings therein, said first connector element connected to said first wire;

a second connector element defining a second plurality of openings therein, said second connector element connected to said second wire; and a plurality of fastening elements for removably positioning through said first and second plurality of openings and for removably fastening together said first and second connector elements and said first and second parts of said device.

2. In a device as in claim 1 wherein said first and second connector elements are each substantially flat.

3. In a device as in claim 2 wherein said first and second plurality of openings are in substantial alignment with each other when said first and second connector elements are positioned together in predetermined relationship.

4. In a device as in claim 3 wherein said fastening elements are bolts and nuts threadable onto said bolts.

5. In a device as in claim 4 wherein said first and second connector elements are each substantially ring-shaped.

6. In a device as in claim 4 wherein said first and second connector elements are each substantially rectangular in shape.

* * * * *